US012214850B2

(12) United States Patent
Adams et al.

(10) Patent No.: US 12,214,850 B2
(45) Date of Patent: Feb. 4, 2025

(54) COMMISSIONING STRATEGY

(71) Applicant: SEAKEEPER, INC., California, MD (US)

(72) Inventors: John D. Adams, Russell Springs, KY (US); Michael Gallagher, Cleveland, OH (US); Kayla Lauren Stanley, Coral Springs, FL (US)

(73) Assignee: SEAKEEPER, INC., California, MD (US)

( * ) Notice: Subject to any disclaimer, the term of this patent is extended or adjusted under 35 U.S.C. 154(b) by 237 days.

(21) Appl. No.: 17/891,651

(22) Filed: Aug. 19, 2022

(65) Prior Publication Data

US 2023/0057840 A1 Feb. 23, 2023

Related U.S. Application Data

(60) Provisional application No. 63/234,894, filed on Aug. 19, 2021.

(51) Int. Cl.

*B63B 79/40* (2020.01)
*B63B 79/10* (2020.01)
*B63B 79/30* (2020.01)

(52) U.S. Cl.

CPC ..... *B63B 79/40* (2020.01); *B63B 79/10* (2020.01); *B63B 79/30* (2020.01)

(58) Field of Classification Search

CPC ..... B63B 79/40; B63B 79/10; B63B 79/30; B63B 39/06

(Continued)

(56) References Cited

U.S. PATENT DOCUMENTS 4,524,942 A 6/1985 Kueny
4,749,926 A 6/1988 Ontolchik
(Continued)

FOREIGN PATENT DOCUMENTS

AU 783746 B2 1/2003
CA 2795437 4/1928
(Continued)

OTHER PUBLICATIONS

US 11,198,496 B2, 12/2021, Wong et al. (withdrawn)
(Continued)

*Primary Examiner* — Muhammad Shafi
(74) *Attorney, Agent, or Firm* — Vedder Price P.C.

(57) ABSTRACT

A software-based commissioning strategy for customization of a new marine vessel having a newly installed stability/dynamic active control system. The commissioning strategy will be implemented by using a proprietary customer-facing software embedded within a software module of a newly installed dynamic active control system for a new marine vessel (and a new hull type). The software-controlled commissioning strategy is configured to automatically determine the appropriate feedback gains for the marine vessel by controlling the deployment of the water engagement devices while simultaneously measuring and capturing the data generated from the resulting list angle, roll angle, roll rate, and yaw rate changes associated with the deployment. The software driven commissioning strategy is further configured for auto-calibrating the following functional parameters of the new marine vessel: (1) Speed-Based Bias Adjustments (SBBAs), (2) Roll Overall Gain (ROG), (3) Pitch Overall Gain (POG) and (4) Yaw Rate Gain (YRG) of the marine vessel.

12 Claims, 11 Drawing Sheets

(58) Field of Classification Search
USPC ..... 701/21
See application file for complete search history.

(56) References Cited

U.S. PATENT DOCUMENTS 5,142,497 A 8/1992 Warrow
5,263,432 A 11/1993 Davis
5,385,110 A 1/1995 Bennett et al.
D362,841 S 10/1995 Roza
5,474,012 A 12/1995 Yamada et al.
6,041,730 A 3/2000 Oliverio et al.
6,268,053 B1 7/2001 Woiszwillo et al.
6,273,771 B1 8/2001 Buckley et al.
6,354,237 B1 3/2002 Gaynor et al.
6,417,469 B1 7/2002 Tamura
6,579,072 B2 6/2003 Trousil et al.
6,592,412 B1 7/2003 Geil et al.
6,651,574 B1 11/2003 Ellens et al.
6,659,816 B2 12/2003 Fuse
6,766,962 B2 7/2004 Paul et al.
6,874,441 B2 4/2005 Pigeon
D507,543 S 7/2005 Ishii et al.
6,928,948 B1 8/2005 Shannon
7,025,026 B2 4/2006 Young et al.
7,040,937 B2 5/2006 Scott et al.
7,059,347 B2 6/2006 Schwartzman
7,128,014 B2 10/2006 Berthiaume et al.
7,128,626 B2 10/2006 Dundra et al.
7,128,627 B2 10/2006 Ferguson
7,137,347 B2 11/2006 Wong et al.
7,140,315 B2 11/2006 Okuyama
7,156,708 B2 1/2007 Dudra
7,171,982 B2 2/2007 Dudra
7,258,072 B2 8/2007 Wong et al.
7,278,367 B1 10/2007 Gonring et al.
7,285,738 B2 10/2007 Lavigne et al.
7,311,058 B1 12/2007 Brooks et al.
7,318,386 B2 1/2008 Dudra et al.
D562,753 S 2/2008 Wall et al.
D562,754 S 2/2008 Wall et al.
7,364,482 B1 4/2008 Wong et al.
7,407,420 B1 8/2008 Fetchko et al.
7,479,607 B2 1/2009 Sack et al.
7,497,183 B2 3/2009 Dudra et al.
7,597,552 B2 10/2009 Young et al.
7,601,040 B2 10/2009 Morvillo
7,631,610 B1 12/2009 Wolske
7,641,525 B2 1/2010 Morvillo
7,717,462 B2 5/2010 Liu et al.
7,722,418 B2 5/2010 Ellens et al.
7,743,721 B2 6/2010 Barrett et al.
7,806,142 B2 10/2010 Baros et al.
7,905,156 B2 3/2011 Scott et al.
7,958,837 B1 6/2011 Fraleigh
7,975,638 B1 7/2011 Harris et al.
8,007,330 B2 8/2011 Wong et al.
8,025,006 B2 9/2011 Baros
8,028,510 B2 10/2011 Scott et al.
8,042,480 B2 10/2011 Simons
8,062,010 B2 11/2011 Paramonoff et al.
D654,880 S 2/2012 Iam
8,113,892 B1 2/2012 Gable et al.
8,141,789 B2 3/2012 Schwartzman et al.
8,145,371 B2 3/2012 Rae et al.
8,151,723 B2 4/2012 Winiski et al.
8,170,734 B2 5/2012 Kaji
8,182,396 B2 5/2012 Martin et al.
8,261,682 B1 9/2012 DeVito
8,264,338 B2 9/2012 Leon
8,347,859 B2 1/2013 Garon et al.
8,387,589 B2 3/2013 Wong et al.
8,406,944 B2 3/2013 Garon et al.
8,435,088 B2 3/2013 Morettin et al.
8,425,270 B2 4/2013 Dudra et al.
8,430,702 B2 4/2013 Davidson et al.
8,457,820 B1 6/2013 Gonring
8,516,916 B2 8/2013 Scott et al.
8,550,023 B1 10/2013 Quail
8,578,838 B2 11/2013 Davidson
8,578,873 B2 11/2013 Gasper et al.
8,583,300 B2 11/2013 Oehlgrien et al.
8,610,013 B2 12/2013 Schmidt et al.
8,612,072 B2 12/2013 Garon et al.
D698,304 S 1/2014 Dubois et al.
D698,357 S 1/2014 Mainville et al.
8,626,962 B2 1/2014 Wong et al.
8,631,753 B2 1/2014 Morvillo
8,672,086 B2 3/2014 Wong et al.
8,683,300 B2 3/2014 Stek et al.
8,751,015 B2 6/2014 Frewin et al.
8,769,944 B2 7/2014 Redfern
8,845,490 B2 9/2014 Chan et al.
D720,305 S 12/2014 Wenji
8,901,443 B2 12/2014 Baker et al.
8,930,050 B2 1/2015 Garon et al.
8,931,707 B2 1/2015 Wilnechenko et al.
8,957,338 B2 2/2015 Li
D725,050 S 3/2015 Tsugawa et al.
D725,612 S 3/2015 Schlegel et al.
8,992,273 B2 3/2015 Winiski et al.
D727,190 S 4/2015 Higgs
8,997,628 B2 4/2015 Sall et al.
9,032,898 B2 5/2015 Widmark
9,068,855 B1 6/2015 Guglielmo
9,104,227 B2 8/2015 Clarke et al.
9,233,740 B2 1/2016 Morvillo
9,260,161 B2 2/2016 Gasper et al.
9,278,740 B1 3/2016 Andrasko et al.
9,334,022 B2 5/2016 Gasper et al.
9,340,257 B2 5/2016 Ulgen
D758,325 S 6/2016 Cook et al.
D758,975 S 6/2016 Hunter et al.
9,377,780 B1 6/2016 Arbuckle et al.
9,423,894 B2 8/2016 Olsson et al.
9,459,787 B2 10/2016 Kulczycki et al.
9,522,723 B1 12/2016 Andrasko et al.
9,559,649 B2 1/2017 Noh et al.
D782,987 S 4/2017 Gassner
9,631,753 B2 4/2017 Wood et al.
9,745,020 B2 4/2017 Snow
9,689,395 B2 6/2017 Hartman
9,710,077 B2 7/2017 Okazaki
9,834,293 B2 12/2017 Wood et al.
D807,309 S 1/2018 Johnson et al.
9,857,794 B1 1/2018 Jarrell et al.
9,896,173 B2 2/2018 Baros et al.
9,911,556 B2 3/2018 Lee et al.
9,944,377 B2 4/2018 Davidson et al.
9,950,771 B1 4/2018 Hartman et al.
D818,973 S 5/2018 Tang et al.
9,978,540 B2 5/2018 Tanaka et al.
9,988,126 B2 6/2018 Wood
9,994,291 B2 6/2018 Scott
10,000,268 B1 6/2018 Poirier et al.
10,040,522 B1 8/2018 Hartman et al.
10,112,692 B1 * 10/2018 Anschuetz ..... G05D 3/00
10,202,179 B2 2/2019 Wong et al.
10,281,928 B2 5/2019 Behling et al.
10,358,189 B2 7/2019 Sheedy et al.
10,370,070 B2 8/2019 Fetchko et al.
10,386,834 B2 8/2019 Green et al.
D858,465 S 9/2019 Desbiens
10,431,099 B2 10/2019 Stewart et al.
10,457,371 B2 10/2019 Hara et al.
D884,856 S 5/2020 Jones et al.
10,647,399 B2 5/2020 Davidson et al.
10,671,073 B2 6/2020 Arbuckle et al.
10,683,073 B2 6/2020 Redfern et al.
10,683,074 B2 6/2020 Davidson et al.
10,696,368 B2 6/2020 Mizutani et al.
10,696,369 B2 6/2020 Takase et al.
10,766,590 B2 9/2020 Nanjo et al.
10,781,947 B2 9/2020 Fetchko et al.
10,829,191 B2 11/2020 Wong et al.

(56) References Cited

U.S. PATENT DOCUMENTS

| | | | |
|---|---|---|---|
| 10,889,358 | B2 | 1/2021 | Wong et al. |
| 10,906,623 | B2 | 2/2021 | Chan et al. |
| 10,940,927 | B2 | 3/2021 | Chan et al. |
| 11,000,268 | B2 | 5/2021 | Poucher et al. |
| 11,040,757 | B2 | 6/2021 | Huyge et al. |
| 11,155,322 | B2 | 10/2021 | Baros |
| 11,319,916 | B2 | 5/2022 | Strang et al. |
| 11,433,981 | B2 | 9/2022 | Chan et al. |
| 11,465,726 | B2 | 10/2022 | Nakatani |
| 11,467,583 | B2 | 10/2022 | Mizutani |
| 11,530,022 | B1 | 12/2022 | Andrasko et al. |
| 11,679,853 | B2 | 6/2023 | Wong et al. |
| 2003/0082964 | A1 | 5/2003 | Simner |
| 2005/0233655 | A1 | 10/2005 | Maselter |
| 2007/0006101 | A1 | 1/2007 | Michaels |
| 2007/0238370 | A1 | 10/2007 | Morvillo |
| 2007/0276563 | A1 | 11/2007 | Kaji |
| 2009/0076671 | A1 | 3/2009 | Mizutani |
| 2009/0165694 | A1 | 7/2009 | Beamer |
| 2010/0094491 | A1 | 4/2010 | Oehlgrien et al. |
| 2010/0102173 | A1 | 4/2010 | Everett et al. |
| 2010/0198435 | A1 | 8/2010 | Cansiani et al. |
| 2011/0000268 | A1 | 1/2011 | Schaafsma et al. |
| 2011/0120364 | A1 | 5/2011 | Mueller |
| 2011/0143608 | A1 | 6/2011 | Chiecchi |
| 2011/0151732 | A1 | 6/2011 | Chiecchi |
| 2011/0320072 | A1* | 12/2011 | Morvillo ..... B63B 39/061 114/285 |
| 2012/0103774 | A1 | 5/2012 | Jun |
| 2012/0247934 | A1 | 10/2012 | Schmidt et al. |
| 2013/0213293 | A1 | 8/2013 | Gasper et al. |
| 2014/0043303 | A1 | 2/2014 | Baker et al. |
| 2014/0183011 | A1 | 7/2014 | Park et al. |
| 2014/0224166 | A1 | 8/2014 | Morvillo |
| 2014/0348207 | A1 | 11/2014 | Wilnechenko et al. |
| 2014/0365050 | A1 | 12/2014 | Morvillo |
| 2016/0097393 | A1 | 4/2016 | Hartman |
| 2017/0250037 | A1 | 8/2017 | Tanaka et al. |
| 2017/0313386 | A1 | 11/2017 | Snow |
| 2017/0349257 | A1 | 12/2017 | Hara et al. |
| 2018/0201342 | A1 | 7/2018 | Huyge et al. |
| 2019/0017900 | A1* | 1/2019 | Converse ..... G01M 13/00 |
| 2020/0303235 | A1 | 9/2020 | Miyadate et al. |
| 2020/0354030 | A1* | 11/2020 | Bowie ..... B63B 39/062 |
| 2021/0107617 | A1 | 4/2021 | Nakatani |
| 2022/0004125 | A1 | 1/2022 | Mitsumata et al. |
| 2022/0334596 | A1 | 10/2022 | Chan et al. |
| 2022/0355913 | A1 | 11/2022 | Davidson et al. |
| 2023/0073225 | A1 | 3/2023 | Chan et al. |
| 2023/0166823 | A1 | 6/2023 | Wood et al. |
| 2023/0257096 | A1 | 8/2023 | Wong et al. |
| 2023/0303235 | A1 | 9/2023 | Wong et al. |

FOREIGN PATENT DOCUMENTS

| | | | |
|---|---|---|---|
| CA | 304073 | A | 9/1930 |
| CA | 2236483 | C | 5/1998 |
| CA | 2372402 | C | 2/2002 |
| CA | 3048271 | A1 | 6/2019 |
| CA | 3048276 | A1 | 6/2019 |
| CA | 3048282 | A1 | 12/2020 |
| CN | 109110073 | A | 1/2019 |
| CN | 112124548 | A | 12/2020 |
| DE | 19837888 | C1 | 8/1998 |
| EP | 0928739 | A2 | 7/1999 |
| JP | H0350087 | A | 3/1991 |
| JP | H0382697 | A | 4/1991 |
| JP | H03114996 | A | 5/1991 |
| JP | H06255577 | A | 9/1994 |
| JP | H09286390 | A | 11/1997 |
| JP | H09315384 | A | 12/1997 |
| JP | 2001294197 | A | 10/2001 |
| JP | 2002-284087 | A | 10/2002 |
| JP | 2003341589 | A | 12/2003 |
| JP | 2004224103 | A | 8/2004 |
| JP | 2005-280550 | A | 10/2005 |
| JP | 2005324716 | A | 11/2005 |
| JP | 2009037287 | A | 4/2009 |
| JP | 2012-035786 | A | 2/2012 |
| JP | 2013035351 | A | 2/2013 |
| JP | 2013100102 | A | 5/2013 |
| JP | 2014196091 | A | 10/2014 |
| JP | 2018030573 | A | 3/2018 |
| KR | 10-2011-0078767 | A | 7/2011 |
| KR | 10-2011-0139800 | A | 12/2011 |
| KR | 10-2012-0019280 | A | 3/2012 |
| KR | 10-1259134 | B1 | 4/2013 |
| KR | 10-1297596 | B1 | 8/2013 |
| KR | 10-2013-0119071 | A | 10/2013 |
| KR | 10-1491661 | B1 | 2/2015 |
| KR | 10-2017-0143039 | A | 12/2017 |
| KR | 10-2275079 | B1 | 7/2021 |
| WO | 2003068590 | A2 | 8/2003 |
| WO | 2006058232 | A1 | 6/2006 |
| WO | 2008100903 | A2 | 8/2008 |
| WO | 2009134153 | A1 | 5/2009 |
| WO | 2010003905 | A1 | 1/2010 |
| WO | 2011099931 | A1 | 8/2011 |
| WO | 2011142870 | A2 | 11/2011 |
| WO | 2016036616 | A1 | 3/2016 |
| WO | 2016209401 | A1 | 12/2016 |
| WO | 2023092228 | A1 | 1/2023 |

OTHER PUBLICATIONS

International Search Report and Written Opinion, filed in PCT/US2022/038964 dated Nov. 28, 2022; 8 pgs.

International Search Report and Written Opinion, filed in PCT/US2022/040944 dated Dec. 2, 2022; 7 pgs.

Volvo Penta; Boat Trim System; Mar. 2017; 4 pgs.

Australian Boat Magazine; The Intriguing Zipwake Trim; May 2015; 6 pgs.

Interceptors/Trim Tabs/Force Producers for Ship Motion Control—Maritime Dynamics, Inc.

International Search Report and Written Opinion, filed in PCT/US2022/038962 dated Nov. 16, 2022; 7 pgs.

International Search Report and Written Opinion, filed in PCT/US2022/038102 dated Nov. 15, 2022; 9 pgs.

AutoTrimPro Electric Owner Install Guide; 48 pgs.

Trygve Lauvdal and Thor I. Fossen; Norwegian University of Science and Technology, Department of Engineering Cybernetics, n-7034 Trondheim, Norway; Nonlinear Non-Minimum Phase Rudder-Roll Damping System for Ships Using Sliding Mode Control; 6 pgs.

Asgei J. Sorenson; Department of Marine Technology, Norwegian University of Science and Technology ; 2013 Department of Marine Technology, NTNU; Marine Control Systems, Propolsion and Motion Control of Ships and Ocean Sructures Lecture Notes; 536 pgs.

European Patent Office Extended European Search Report mailed Aug. 26, 2022 from corresponding European Patent Application No. 19869718.7; 7 pages.

WIPO, Canadian International Searching Authority, International Search Report mailed Dec. 13, 2019 in corresponding International Patent Application No. PCT/CA2019/051410, 3 pages.

WIPO, Canadian International Searching Authority, Written Opinion mailed Dec. 4, 2019 in corresponding International Patent Application No. PCT/CA2019/051410, 6 pages.

LENCO—We Make The Best Boats Better !; The World Leader In Trim Tab Systems & Hatch Lift Innovation Owner's Manual; May 21, 2019; 28 pgs.

* cited by examiner

COMMISSIONING STRATEGY

CROSS-REFERENCE TO RELATED APPLICATION

This Application claims the benefit of and priority to U.S. Provisional Application No. 63/234,894, filed Aug. 19, 2021, the content of which is hereby incorporated by reference.

FIELD OF THE DISCLOSURE

The present disclosure generally relates to a commissioning strategy for providing optimum stability performance and control of dynamic active motions of a marine vessel. More specifically, the present disclosure is directed to a software-based commissioning strategy to automatically determine the appropriate feedback gains for a dynamic active control system integrated within a new marine vessel by deploying water engagement devices and measuring the resulting list, roll angle, roll rate and yaw rate changes associated with such deployment.

BACKGROUND

The following terms and related definitions are used in the marine stabilization industry. "Trim Control" means the control of the average angle about the lateral or pitch axis of a marine vessel, averaged over one second or more. "List Control" or "Roll Control" means the control of the average angle about the longitudinal or roll axis of a marine vessel, averaged over one second or more. "Yaw Control" means the control of the average angle about the yaw axis of a marine vessel, averaged over one second or more.

A "Water Engagement Device" or "WED" means a mechanical or electromechanical device configured to generate a variable amount of lift in a marine vessel by selective engagement of the device with or into the water flow under or adjacent to a transom surface of the marine vessel when the marine vessel is underway in a certain (or forward) direction or by changing the angle of attack of the device relative to the water flow during operation of a marine vessel in a forward direction. A WED delta position is defined as the difference between port and starboard WED deployments. "Deployment" means selective engagement of the WED with or into the water flow or a change in the WED angle of attack. A "Roll Moment" in a marine vessel is the result of a force applied to the vessel that causes the vessel to rotate about its longitudinal or roll axis. A "Pitch Moment" in a marine vessel is the result of a force applied to the vessel that causes the vessel to rotate about its lateral or pitch axis. A "Yaw Moment" in a marine vessel is the result of a force applied to the vessel that causes the vessel to rotate about its vertical or yaw axis. For instance, (1) a Roll Moment can be generated if the port and starboard WEDs are deployed asymmetrically in a marine vessel that may cause the vessel to roll; (2) a Yaw Moment can be generated when port and starboard WEDs are deployed asymmetrically which may cause a heading change; and (3) a Pitch Moment can be generated if the port and starboard WEDs are deployed symmetrically or if a single WED is deployed about the center of the marine vessel which may cause the vessel to pitch.

Conventional marine stabilization techniques for when a vessel is underway in a forward direction include proportional deployment of WEDs to generate a continuous lift at the transom of the vessel for trim control while allowing adjustment of the angles (e.g., along the roll, pitch yaw axis) of the marine vessel. A few examples of commercially available WEDs—not to be considered exhaustive by any means—are interceptors, trim tabs, and fins and other similar devices that can engage the water flow in similar fashion and provide similar functionality.

Marine stabilization technologies are key to experiencing the joy of cruising over waters without the attendant random environmentally induced disturbances of the boat. These disturbances—for example, a sudden unexpected roll—can be annoying and disruptive to boaters. In the existing prior art systems, WEDs are designed and configured to control list and trim—to get the marine vessel to an average angle in the roll and pitch axis. Smaller marine vessels used in the recreational market generally have manually actuated WEDs, while larger vessels operating in the commercial space use automatic actuated systems to stabilize the motion. However, such prior art systems do not user specific customization of marine stability control systems for complete vessel stabilization.

There are no currently available prior art recreational or commercial user-specific customizable stability/dynamic active control systems for marine vessels that combine the fast deployment of water engagement devices with engine trim adjustments and engine steering angle adjustment. More specifically, prior art systems lack the combination of fast deployment of WEDs with adjustment of the engine steering angle of the marine vessel to counter changes in drag due to asymmetric deployment, gyroscopic stabilization, yaw moment and/or adjustment of the engine trim for dynamic control in the pitch axis.

In view of the foregoing problems and issues in the relevant field of marine stabilization, there is clearly a market need for an improved stability control system of a marine vessel—a dynamic active control system—configured to simultaneously control accelerations, rates and angles in the roll, pitch and yaw axes of the marine vessel. As discussed above, one of the largest challenges associated with any stability or dynamic active control system is the adaptation or customization of the system for different types of marine vessels (and different types of hulls). Further, in that context, there is clearly a need within the industry for a commissioning strategy for customization and implementation of new stability/dynamic active control systems in different marine vessels. As further disclosed below, to adapt a stability control or dynamic active control system to a new hull type (of a marine vessel), any software-based strategy will need to determine at least (a) the relationship between asymmetric deployment of the water engagement devices and the resulting roll and yaw motion of the marine vessel and (b) the relationship between symmetric deployment of the water engagement devices and the resulting pitch motion of the marine vessel. Prior art and conventional marine stabilization systems do not provide such automatic means of characterizing these functional relationships as will be disclosed herein.

The present disclosure is directed to a software-based commissioning strategy used during review of a newly installed a stability/dynamic active control system for a new marine vessel. The commissioning strategy is directed to automatically capture, store, interpret and analyze data regarding the relationship between the deployment of water engagement devices and parameters associated with the various vessel motions. The system as part of the commissioning strategy is configured to provide feedback gains from the data derived from the relationship between deployment and parameters related to vessel motions and provide customization option to an operator of the new marine vessel. The commissioning strategy disclosed herein provides significant technological advantages from conventional marine stability control systems while overcoming the disadvantages of any prior art systems, as further discussed below.

BRIEF SUMMARY OF THE INVENTION

The present disclosure is directed to a software-based commissioning strategy for customization of a new marine vessel having a newly installed stability/dynamic active control system. The commissioning strategy will be implemented by using a proprietary customer-facing software embedded within a software module of a newly installed dynamic active control system for a new marine vessel (and a new hull type). The commissioning strategy is configured to measure the relationship between deployment of the water engagement devices (differential or symmetrical) and the resulting motions of the marine vessel in order to determine the optimum overall gain (e.g., roll overall gain, pitch overall gain, yaw rate gain) based on that transfer function relationship between the deployment and the marine vessel motion, as further described below. A water engagement device is not necessarily limited to any particular device such as an interceptor, trim tab and/or a fin but can include other similar devices that can engage the water flow in a similar fashion and provide similar functionality during operation of the marine vessel.

In an aspect of the present disclosure, a commissioning method for a new marine vessel comprises the steps of (1) installing a dynamic active control system having an user-interface connected to a software module having an embedded microprocessor, wherein the software module is communicatively and operatively connected to at least one pair of water engagement devices, (2) prompting a user to activate the system to asymmetrically deploy the at least one pair of water engagement devices; (3) processing a first set of data related to the roll motion of the vessel generated from the asymmetrical deployment of the at least one pair of water engagement devices, wherein the first set of data includes parameters of the functional relationship between the asymmetrical deployment of the at least one pair of water engagement devices and the roll motion the marine vessel; (4) analyzing the processed first set of data to automatically generate a vessel-specific Roll Overall Gain parameter derived from the first set of data; (5) processing a second set of data related to the yaw motion of the vessel generated from the asymmetrical deployment of the at least one pair of water engagement devices, wherein the second set of data includes parameters of the functional relationship between the asymmetrical deployment of the at least one pair of water engagement devices and the yaw motion of the marine vessel; (6) analyzing the processed second set of data to generate a vessel-specific Yaw Rate Gain parameter derived the second set of data; and (7) storing the vessel-specific Roll Overall Gain parameter and the vessel-specific Yaw Rate Gain parameter within the dynamic active control system of the marine vessel.

In another aspect of the present disclosure, a commissioning method for a new marine vessel comprises the steps of (1) installing a dynamic active control system having an user-interface connected to a software module having an embedded microprocessor, wherein the software module is communicatively and operatively connected to at least one pair of water engagement devices; (2) prompting a user to activate and instruct the system to symmetrically deploy the at least one pair of water engagement devices; (3) processing data related to the roll motion of the vessel generated from the symmetrical deployment of the at least one pair of water engagement devices, wherein the data includes parameters of the functional relationship between the symmetrical deployment of the at least one pair of water engagement devices and the pitch axis motion of the marine vessel; (4) analyzing the processed data to generate a vessel-specific Pitch Overall Gain parameter derived from the data; and (5) storing the vessel-specific Pitch Overall Gain parameter within the dynamic active control system of the marine vessel.

In other aspects of the present disclosure, a software-controlled commissioning strategy is configured to automatically determine the appropriate feedback gains for the marine vessel by controlling the deployment of the water engagement devices while simultaneously measuring and capturing the data generated from the resulting list angle, roll angle, roll rate and yaw rate changes associated with the deployment. The commissioning strategy is further configured for auto-calibrating the following functional parameters of the new marine vessel: (1) Speed-Based Bias Adjustments (SBBAs), (2) Roll Overall Gain (ROG), (3) Pitch Overall Gain (POG) and (4) Yaw Rate Gain (YRG) of the marine vessel.

Certain embodiments are shown in the drawings. However, it is understood that the present disclosure is not limited to the arrangements and instrumentality shown in the attached drawings.

BRIEF DESCRIPTION OF THE DRAWINGS

The accompanying drawings incorporated in and forming a part of the specification illustrate several aspects of the present disclosure and, together with the description, serve to explain the principles of the embodiments.

DETAILED DESCRIPTION OF THE DISCLOSURE

Figure 1:
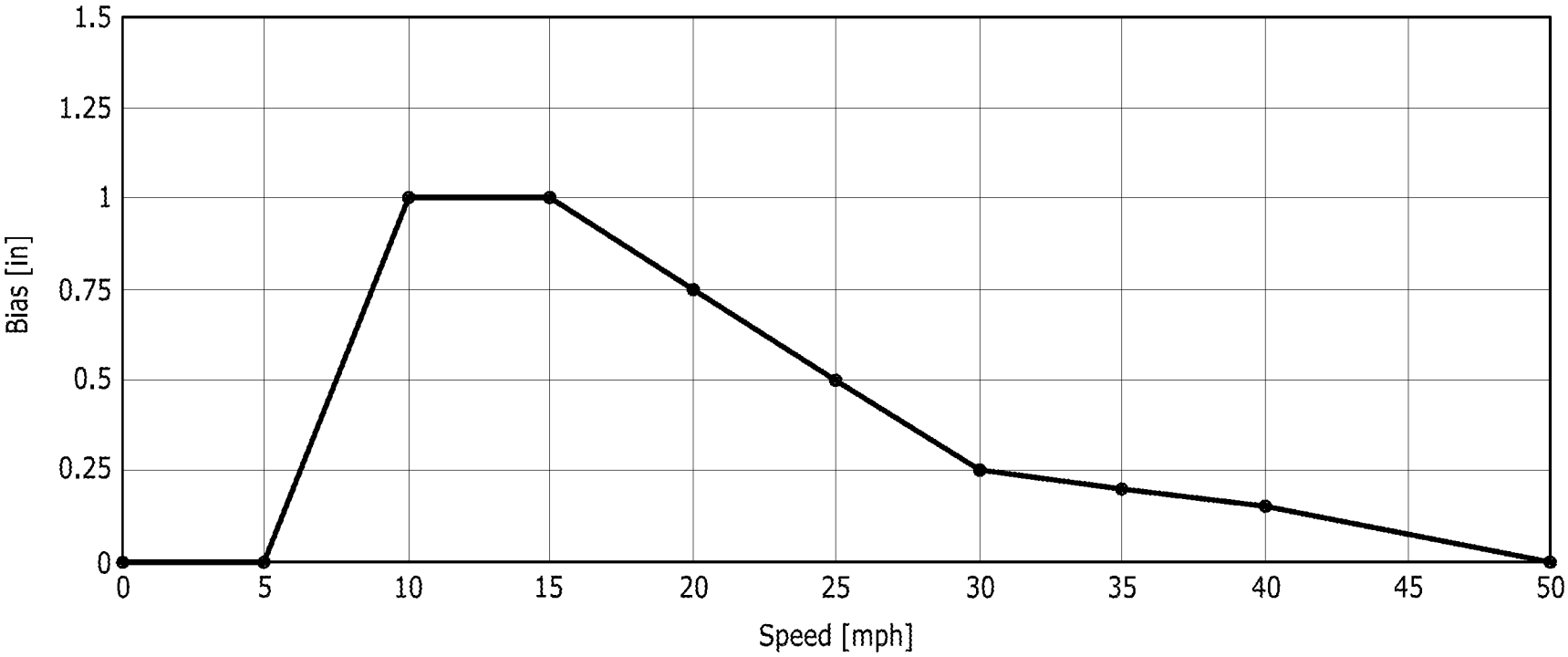
FIG. 1 illustrates a graph depicting the speed-based bias adjustments for a marine vessel according to one aspect of the present disclosure.

For the purposes of promoting and understanding the principles disclosed herein, reference is now made to the preferred embodiments illustrated in the drawings, and specific language is used to describe the same. Embodiments disclosed in the present disclosure provide a novel and improved commissioning strategy for a new marine vessel.

A software-based commissioning strategy—for customization of the marine vessel—comprises the steps of tuning and scaling a new marine vessel (with a new hull type) having a newly installed stability/dynamic active control system. A stability/dynamic active control system for a marine vessel generally comprises a software module communicatively and operatively connected to a plurality of water engagement devices attached to the marine vessel. The plurality of water engagement device actuators comprises at least one pair of water engagement devices configured for both symmetrical (both in the up and down positions) and asymmetrical (differentially deployed—one in the up and one in the down position) deployment. The software module running proprietary program instructions drives the commissioning strategy via the series of short and timed tests on the system, as further explained below.

In an aspect of the present disclosure, the first step in the commissioning strategy is for the user to activate the stability/dynamic active control system in order to deploy the at least one pair of the water engagement devices asymmetrically. Once the at least one pair of the water engagement devices are deployed asymmetrically, the system is configured to measure and process a first set of data related to the roll motion and a second set of data related to the yaw motion generated from the asymmetrical deployment of the water engagement devices. The system is further configured to process the first set of data—the first set of data further comprising parameters of the functional relationship between the asymmetrical deployment of the at least one pair of water engagement devices and the roll motion the marine vessel. The system next analyzes the processed first set of data to automatically generate a vessel-specific ROG parameter derived from the first set of data. The system next processes the second set of data related to the yaw motion of the vessel generated from the asymmetrical deployment of the at least one pair of water engagement devices—the second set of data further comprising parameters of the functional relationship between the asymmetrical deployment of the at least one pair of water engagement devices and the yaw motion of the marine vessel. The system next analyzes the processed second set of data to generate a vessel-specific Yaw Rate Gain parameter derived the second set of data. Once the vessel-specific ROG and YRG are generated by the system—the vessel-specific Roll Overall Gain parameter and the vessel-specific Yaw Rate Gain parameter are stored within the dynamic active control system of the marine vessel.

In another aspect of the present disclosure, the first step in the commissioning strategy is for a user to activate and instruct the system to symmetrically deploy the at least one pair of water engagement devices. Once the at least one pair of the water engagement devices are deployed symmetrically, the system is configured to measure and process data related to the roll motion of the vessel generated from the symmetrical deployment of the at least one pair of water engagement devices—the data further comprising parameters of the functional relationship between the symmetrical deployment of the at least one pair of water engagement devices and the pitch axis motion of the marine vessel. The system as part of the commissioning strategy next analyzes the processed data to generate a vessel-specific POG parameter derived from the data. Once the vessel-specific POG is generated by the system—the vessel-specific Pitch Overall Gain parameter is stored within the dynamic active control system of the marine vessel.

In another aspect of the present disclosure, the software-driven commissioning strategy is further configured for auto-calibrating the Speed-Based Bias Adjustments (SBBAs) of the new marine vessel. FIG. 1 illustrates a graph depicting the SBBAs for a marine vessel according to one aspect of the present disclosure. Data from the marine vessel will be used to initially define the graph which can then be customized by the user. As illustrated in FIG. 1, the SBBAs are configured to generate a default bias at higher speeds of the marine vessel while assisting the marine vessel with getting on plane during operation of the vessel. During the commissioning process, a default SBBA curve will be derived using the marine vessel data provided by the operator. The default SBBA is stored within the software module giving an operator the flexibility to manually adjust the SBBA curve after it is calculated as part of the operator or user specific commissioning strategy for customization of the marine vessel.

Figure 2:
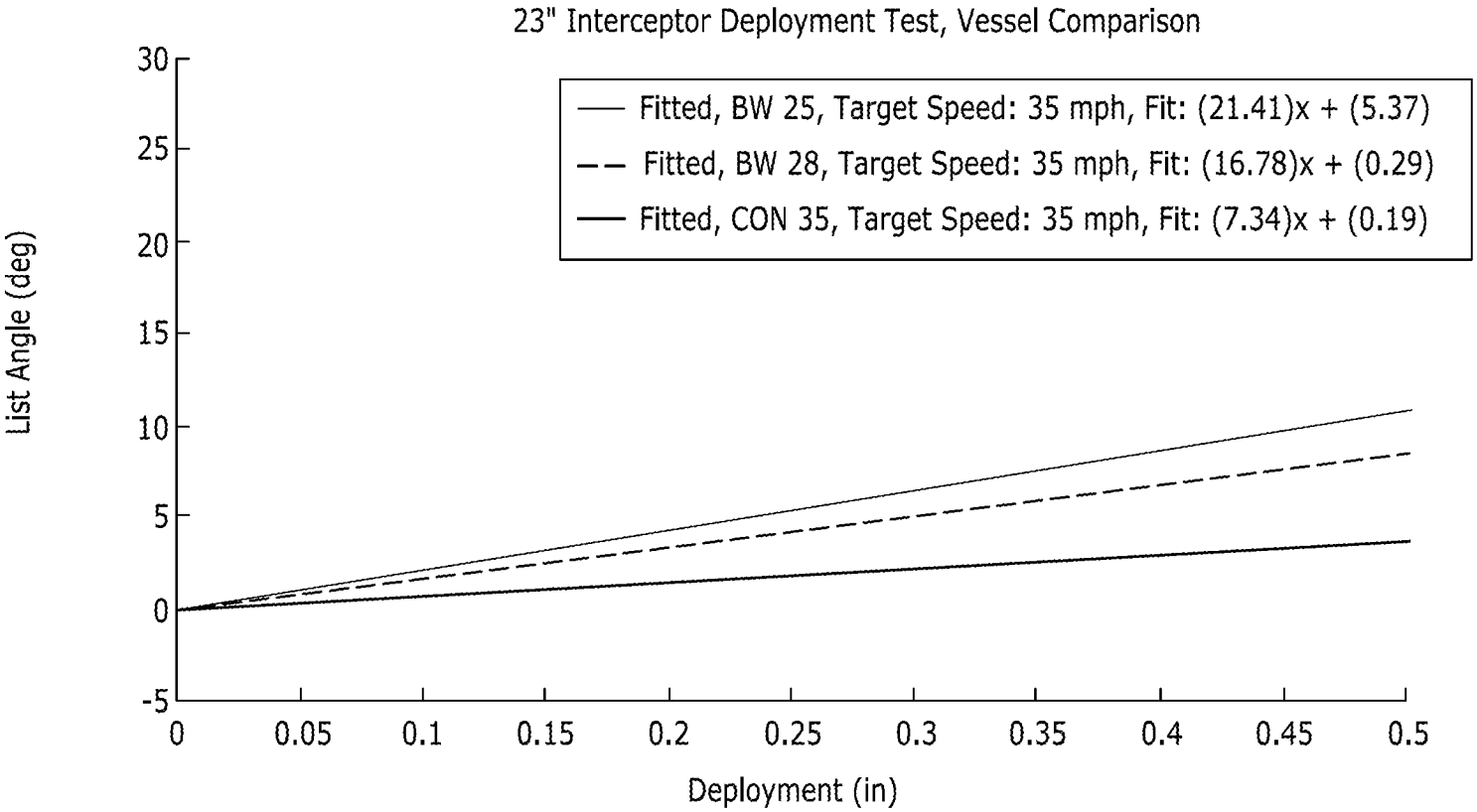
FIG. 2 illustrates the relationship between differential deployment of at least one pair of the water engagement devices and resulting list angle for three different marine vessel hulls.

FIG. 2 illustrates the relationship between asymmetrical (or differentially) deployed water engagement devices and the resulting list angle generated for three different types of marine vessel hulls. As shown in FIG. 2, BW25 refers to a 25 foot Center Console Boat, BW28 refers to a 28 foot Center Console Boat and CON35 refers to a 35 foot Center Console Boat. The slope of each line in FIG. 2 is functionally related to the desired ROG and the desired YRG for each type of marine vessel. The ROG measures and mitigates any aggressive feedback data related to measurement of the list angle, roll angle and roll rate of the marine vessel. During the commissioning process for a new marine vessel, an appropriate functional relationship is determined between the list angle and the generated asymmetric deployment slope (each line in FIG. 2 representing a specific type of marine vessel hull). The proprietary algorithm controlling the commissioning strategy—the commissioning algorithm—is programmed to define and provide a suggested or recommended Roll Overall Gain parameter for the marine vessel. Next, after such determination, the commissioning process is designed to provide an option to the operator of the marine vessel to have the control of the system and perform a series of static tests to determine the transfer function relationship between differential deployment of the at least one pair of the water engagement devices and the output list angle feedback provided by the system. Based on the determination, a vessel-specific ROG parameter will be assigned as part of the customized user-specific commissioning strategy for the new marine vessel.

Figure 3:
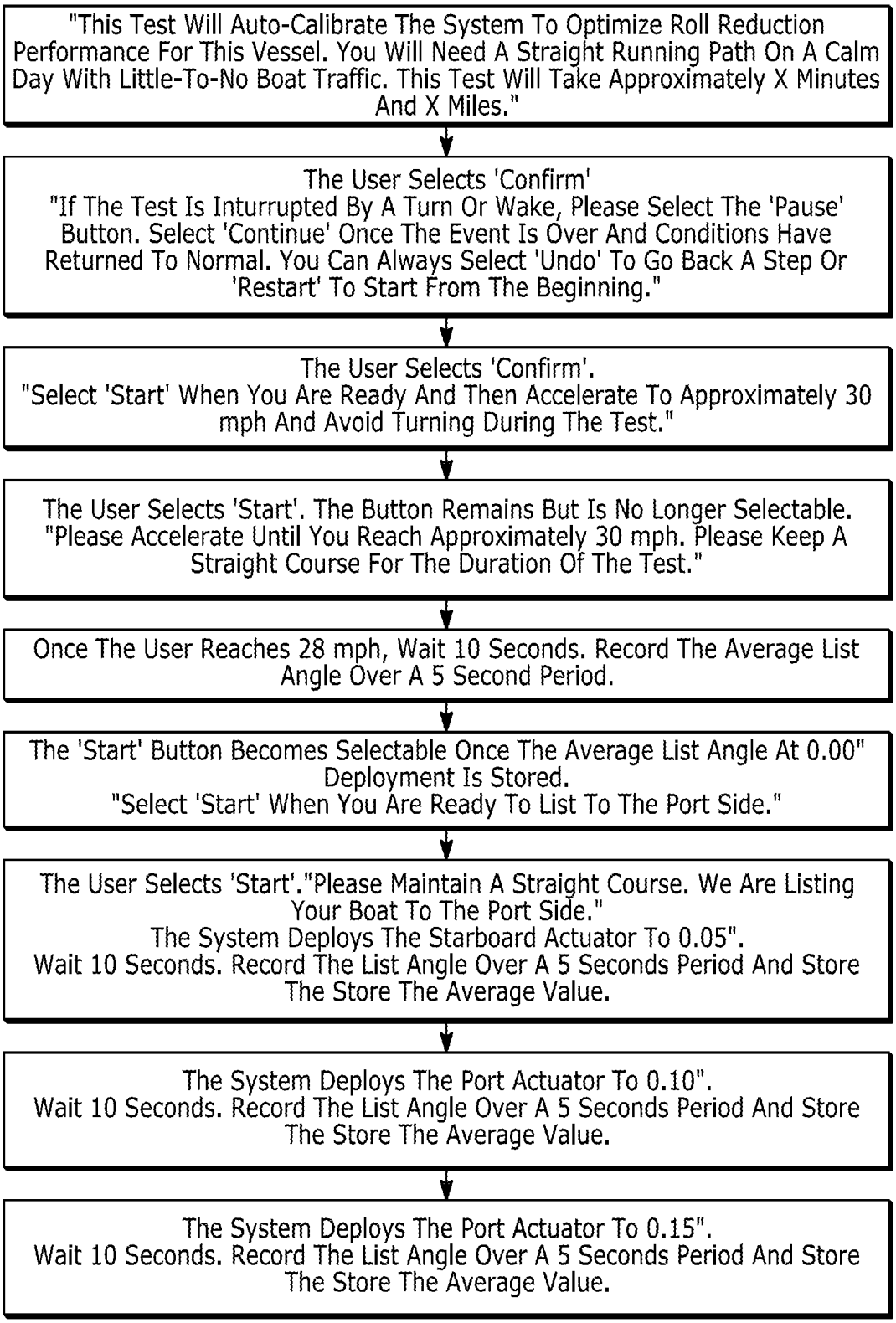
FIG. 3 illustrate an embodiment of the Commissioning Strategy in order to auto-calibrate a dynamic active control system for optimization of roll reduction performance (RRP) according to one aspect of the present disclosure.
Figure 3:
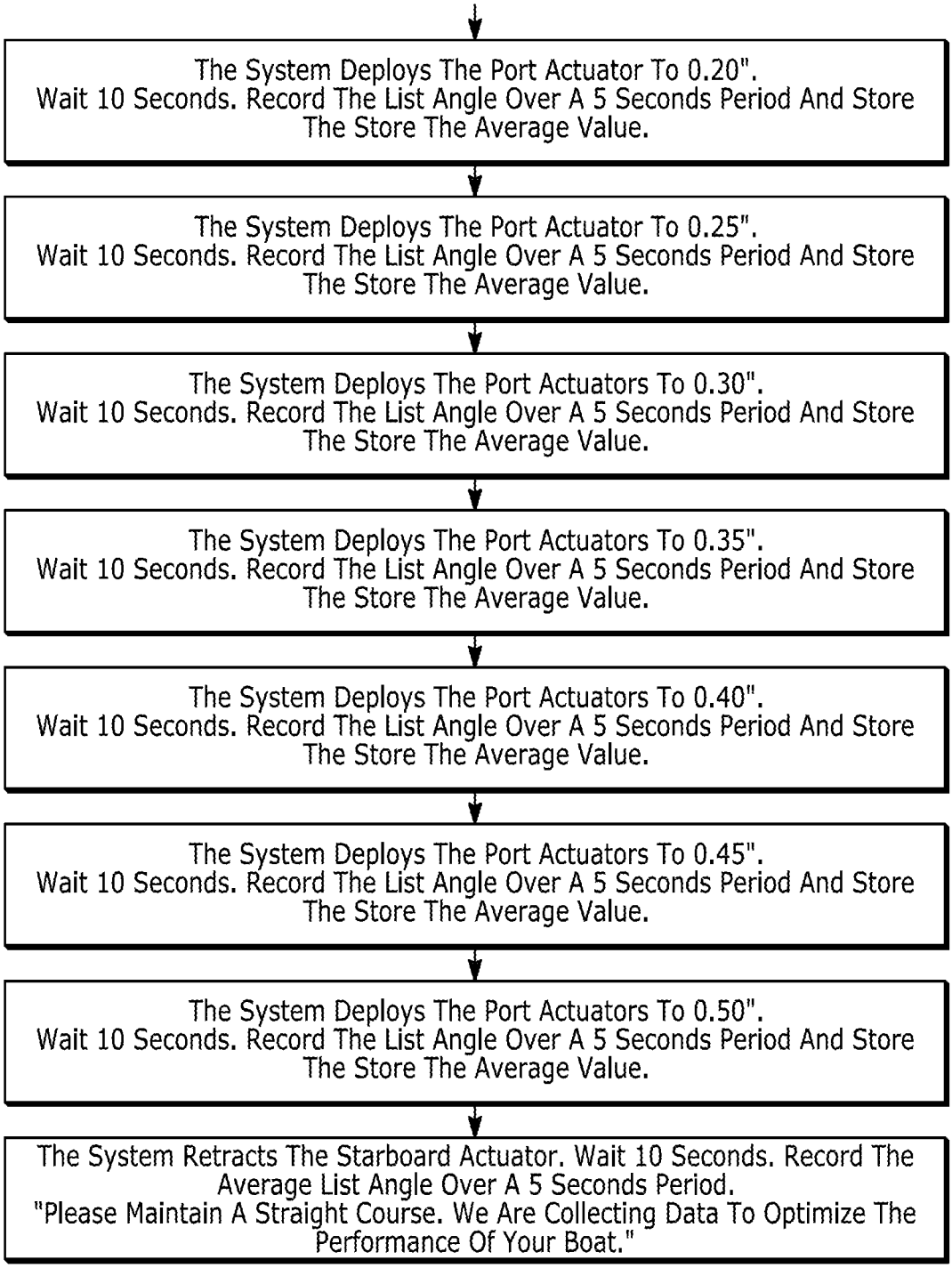
Figure 3:
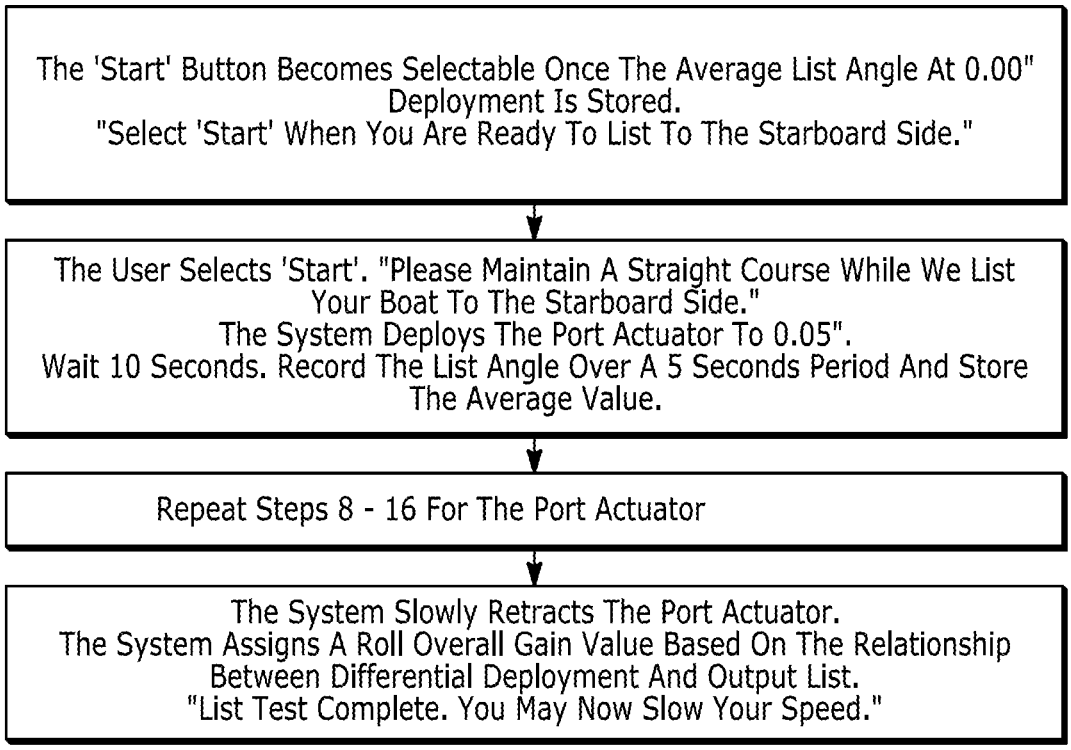

FIG. 3 illustrate an embodiment of the commissioning strategy in order to auto-calibrate the system for optimization of RRP according to one aspect of the present disclosure. As shown in FIG. 3, the commissioning strategy comprises a series of short timed tests configured to provide step by step instruction to the user to auto-calibrate the system and optimize the RRP of the marine vessel.

Figure 4:
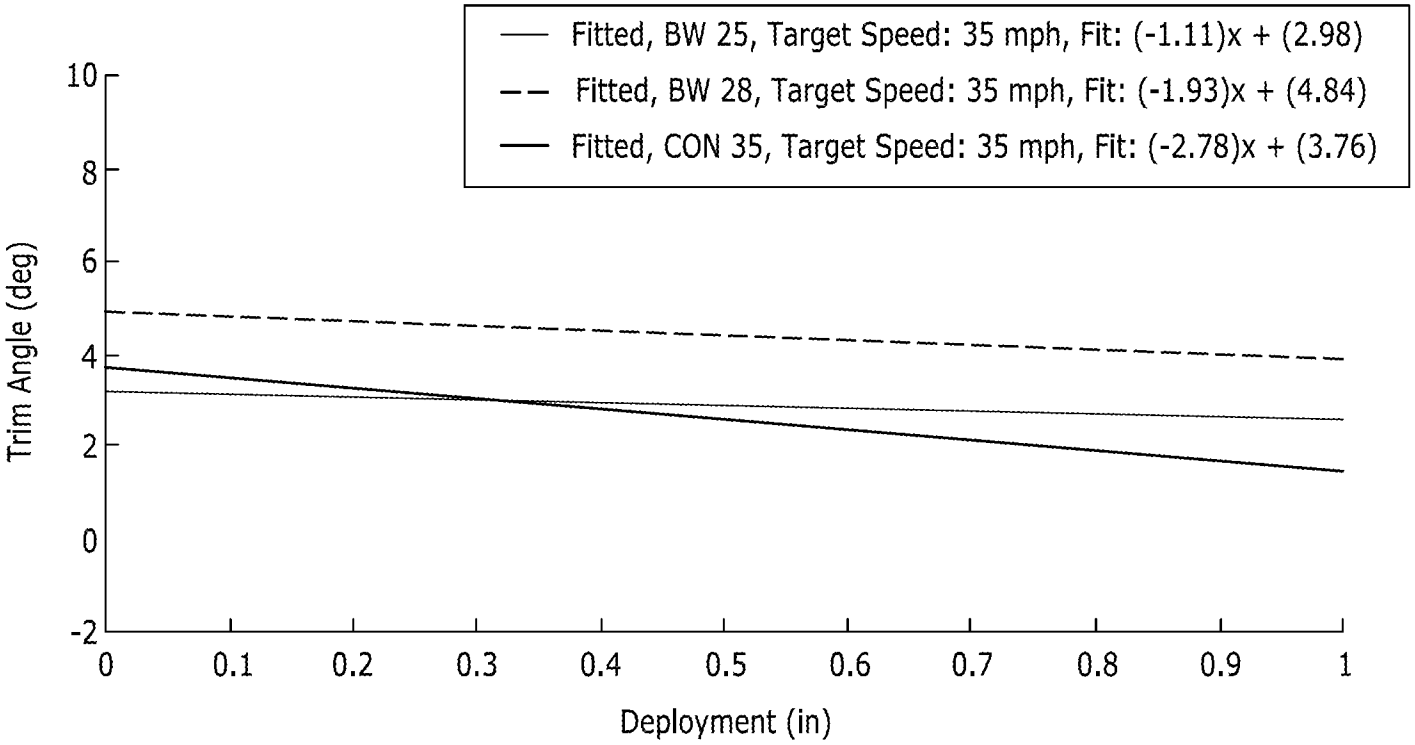
FIG. 4 illustrates the relationship between the symmetric deployment of at least one pair of the water engagement devices and the resulting trim angle for three different marine vessel hulls.

FIG. 4 illustrates the relationship between the symmetric deployment of at least one pair of the water engagement devices and the resulting trim angle for three different marine vessel hulls. As shown in FIG. 4, BW25 refers to a 25 foot Center Console Boat, BW28 refers to a 28 foot Center Console Boat and CON35 refers to a 35 foot Center Console Boat. The slope of each line in FIG. 4 is functionally related to the desired POG for each type of marine vessel. As illustrated in FIG. 4, the software-controlled commissioning strategy provides a POG similar to the ROG discussed above—the POG measures and mitigates any aggressive feedback data related to the pitch angle and pitch rate for the marine vessel. During the commissioning process for a new marine vessel, an appropriate functional relationship is determined between the trim angle and the generated symmetric deployment slope (each line in the FIG. 4 representing a specific type of marine vessel hull). The proprietary algorithm controlling the commissioning strategy—the commissioning algorithm—is programmed to define and provide a suggested or recommended Pitch Overall Gain parameter for the marine vessel. Next, after such determination, the commissioning process is designed to provide an option to the operator of the marine vessel to have the control of the system and perform a series of static tests to determine the transfer function relationship between the symmetrical deployment of at least one pair of the water engagement devices and the output trim angle (both in degrees and inches). Based on the determination, a vessel-specific POG parameter will be assigned as part of the customized user-specific commissioning strategy for the new marine vessel.

Figure 5:
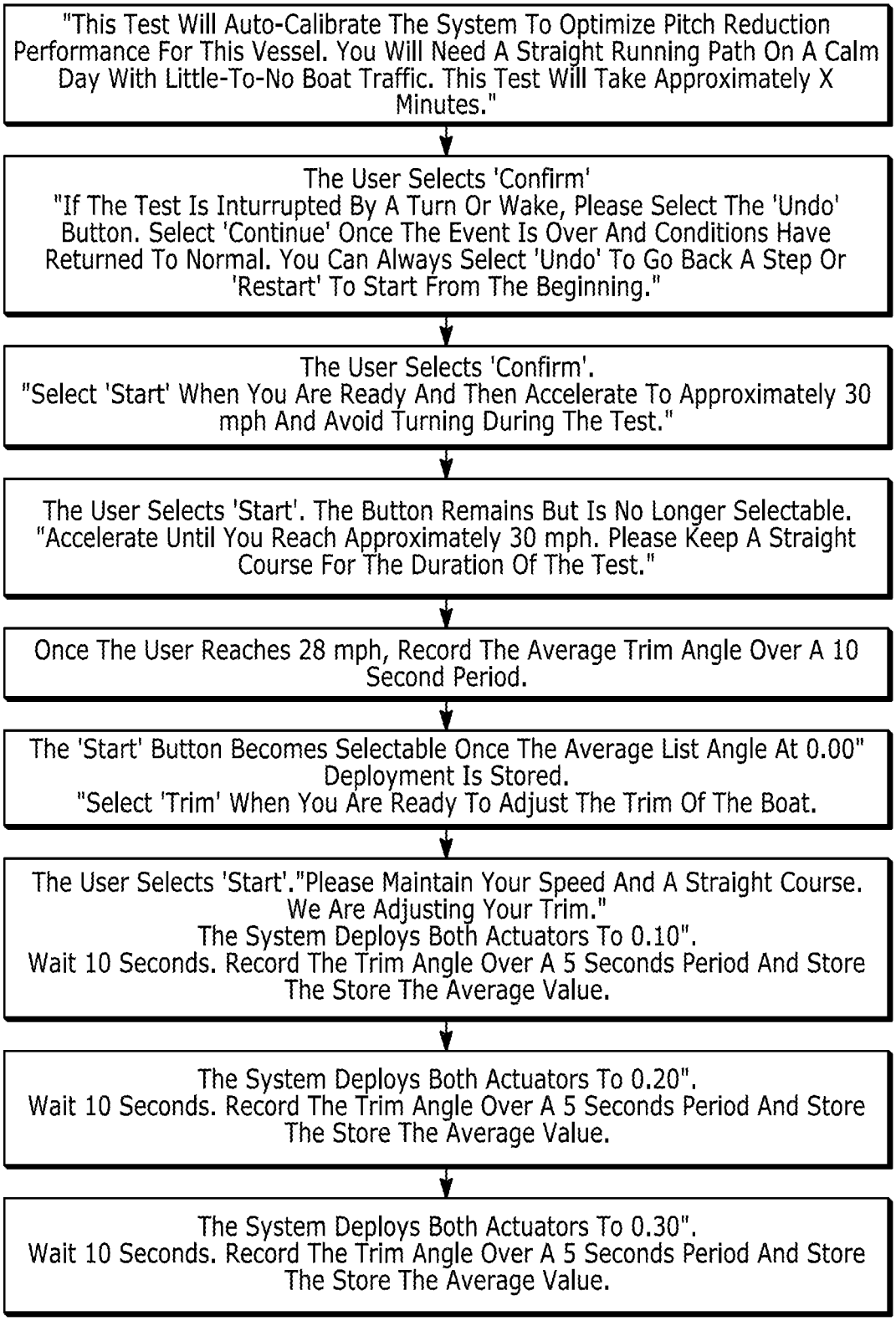
FIG. 5 illustrates an embodiment of the Commissioning Strategy in order to auto-calibrate a dynamic active control system for optimization of pitch reduction performance (PRP) according to one aspect of the present disclosure.
Figure 5:
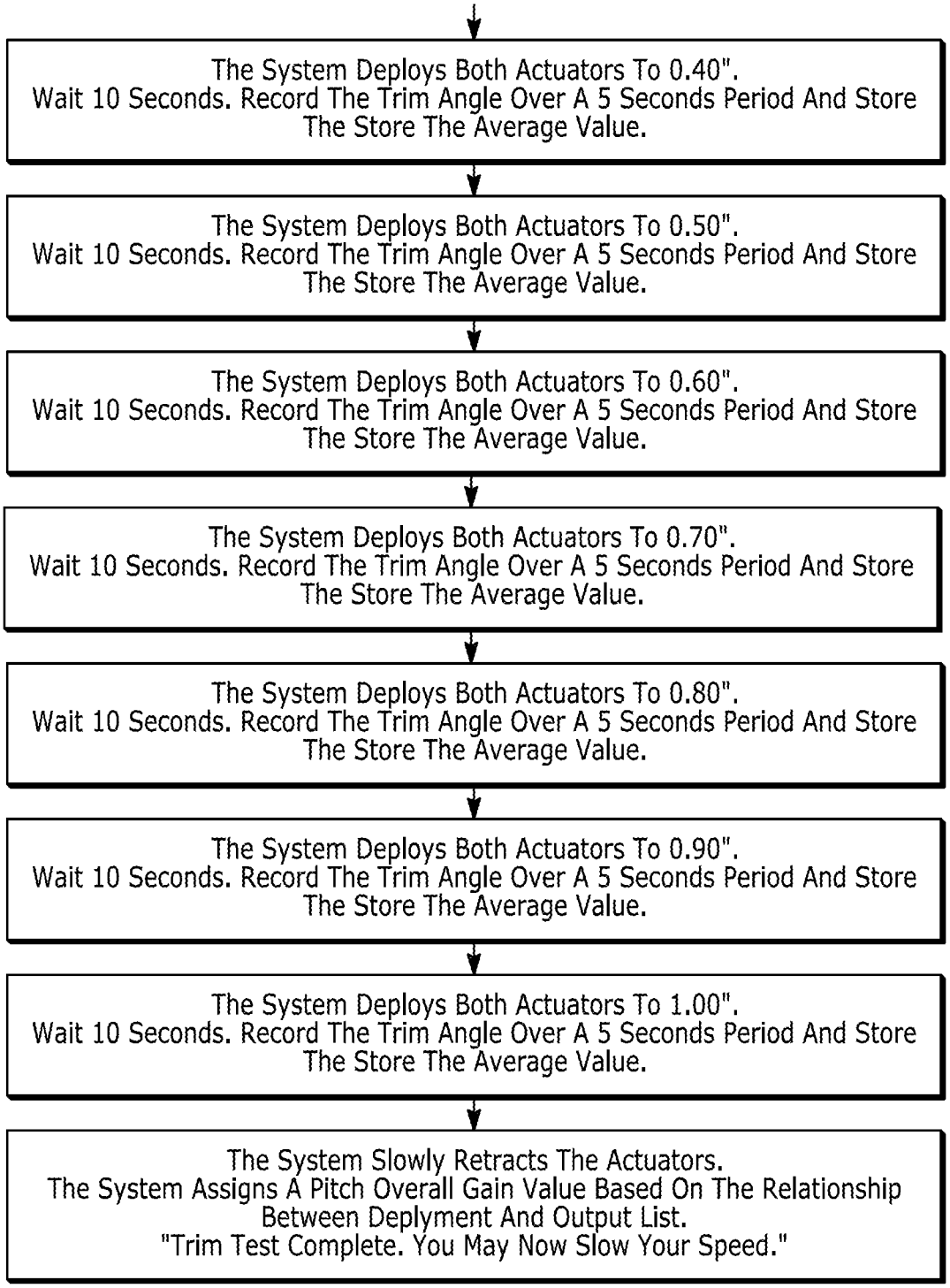

FIG. 5 illustrates an embodiment of the Commissioning Strategy in order to auto-calibrate a dynamic active control system for optimization of pitch reduction performance (PRP) according to one aspect of the present disclosure. As shown in FIG. 5, the commissioning strategy comprises a series of short timed test configured to provide step by step instruction to the user to auto-calibrate the system and RRP of the marine vessel.

Figure 6:
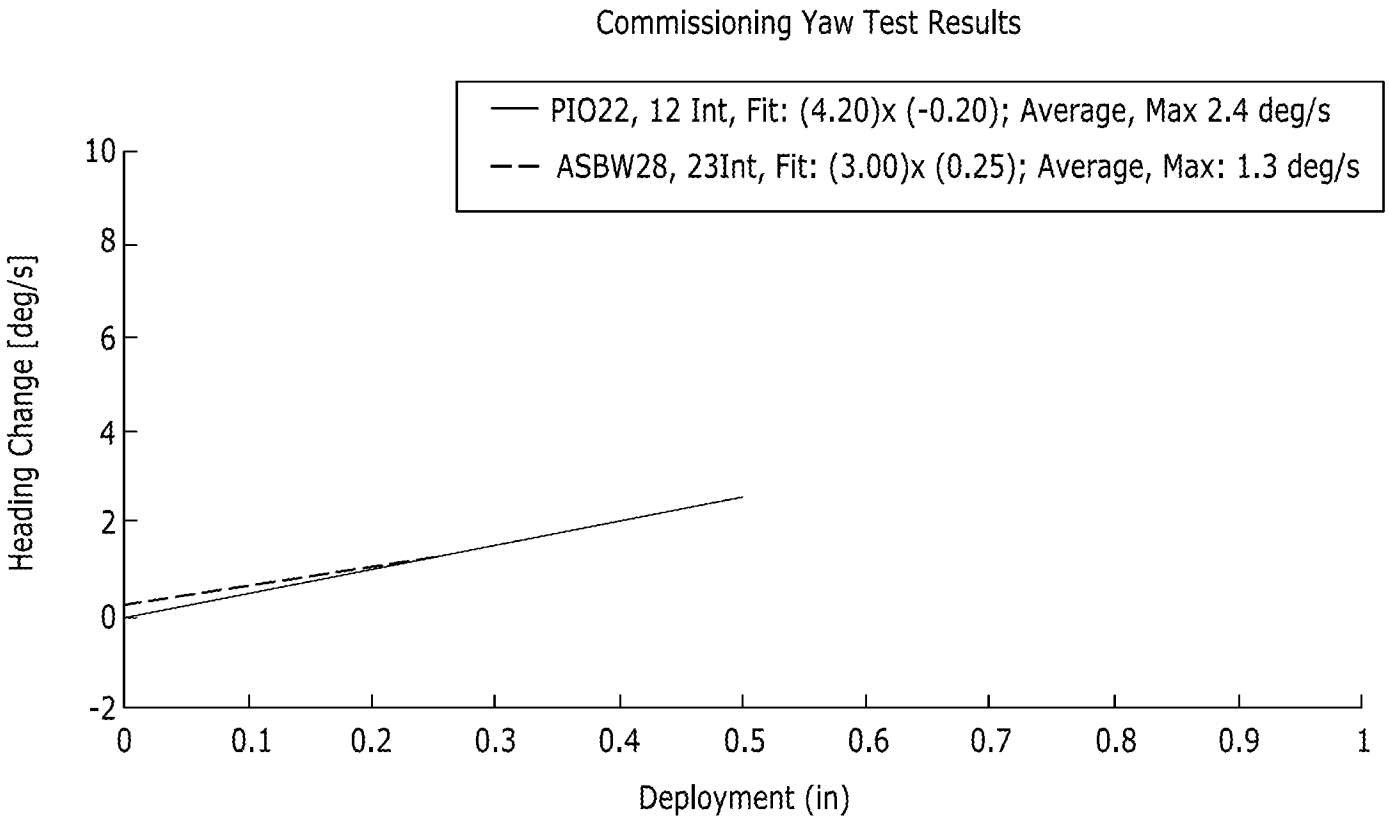
FIG. 6 illustrates the relationship between asymmetric deployment at least one pair of the water engagement devices and the resulting yaw rate/heading change for two different marine vessel hulls according to one aspect of the present disclosure.

FIG. 6 illustrates the relationship between asymmetric deployment at least one pair of the water engagement devices and the resulting yaw rate/heading change for two different marine vessel hulls according to one aspect of the present disclosure. As shown in FIG. 6, ASBW28 refers to a 28 foot Center Console Boat and PIO22 refers to a 22 foot Center Console Boat. The slope of each line in FIG. 6 is functionally related to the desired YRG for each type of marine vessel. As illustrated in FIG. 6, the software-controlled commissioning strategy provides a vessel-specific YRG similar to the vessel-specific ROG and POG parameters. The YRG measures and mitigates any aggressive feedback data related to measurement of the yaw rate of the marine vessel. During the commissioning process for a new marine vessel, an appropriate functional relationship is determined between the yaw rate and the generated asymmetric deployment slope (each line in the FIG. 6 representing a specific type of marine vessel hull). The proprietary algorithm controlling the commissioning strategy—the commissioning algorithm—is programmed to define and provide a suggested or recommended Yaw Rate Gain for the marine vessel. Next, after such determination, the commissioning process is designed to provide an option to the operator of the marine vessel to have the control of the system and perform a series of static tests to determine the transfer function relationship between the asymmetric deployment of at least one pair of the water engagement devices and the output yaw rate (both in degrees and inches). Based on the determination, a vessel-specific YRG parameter will be assigned as part of the customized user-specific commissioning strategy for the new marine vessel.

Figure 7:
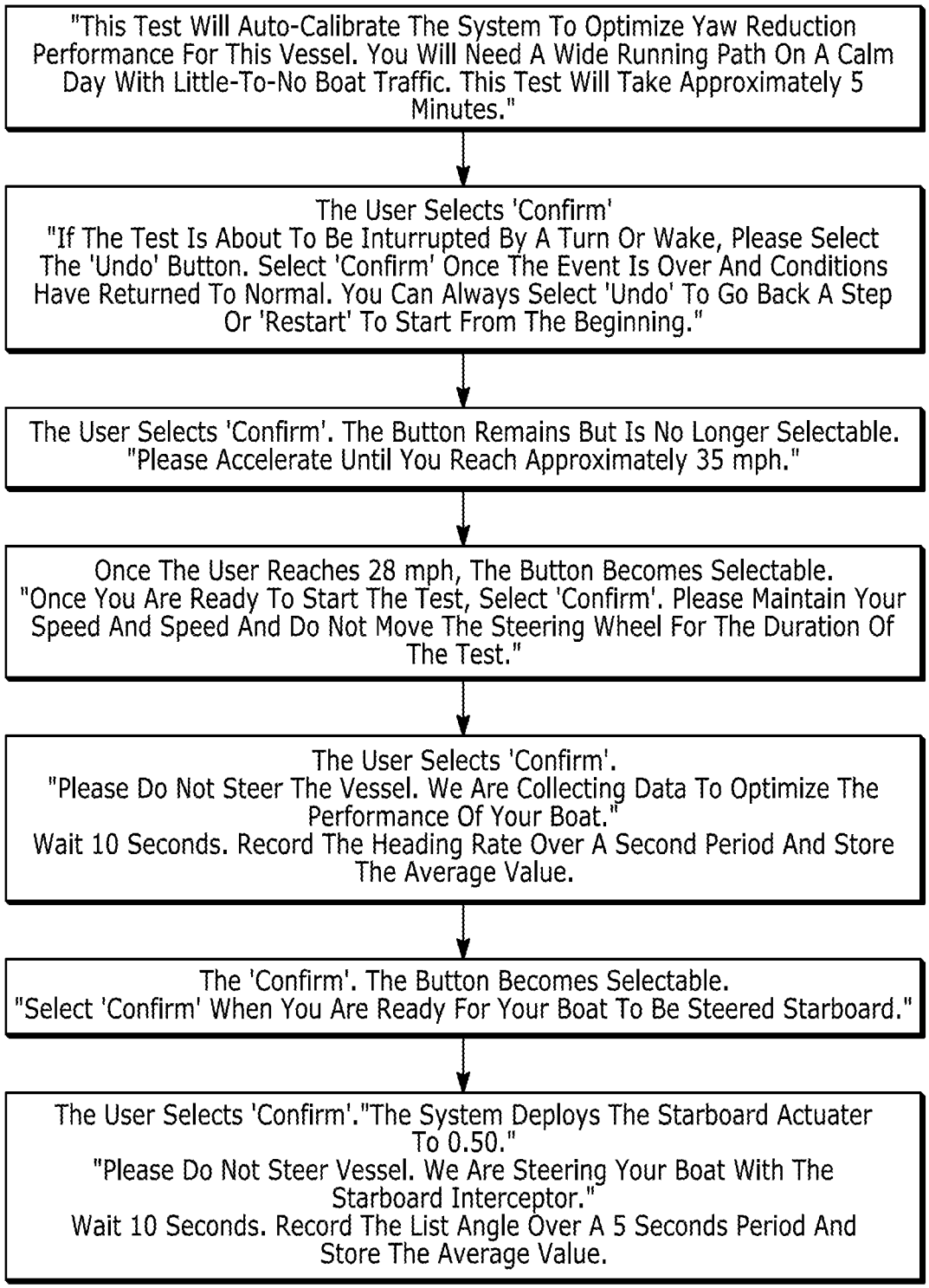
FIG. 7 illustrates an embodiment of the Commissioning Strategy in order to auto-calibrate a dynamic active control system for optimization of yaw reduction performance (YRP) according to one aspect of the present disclosure.
Figure 7:
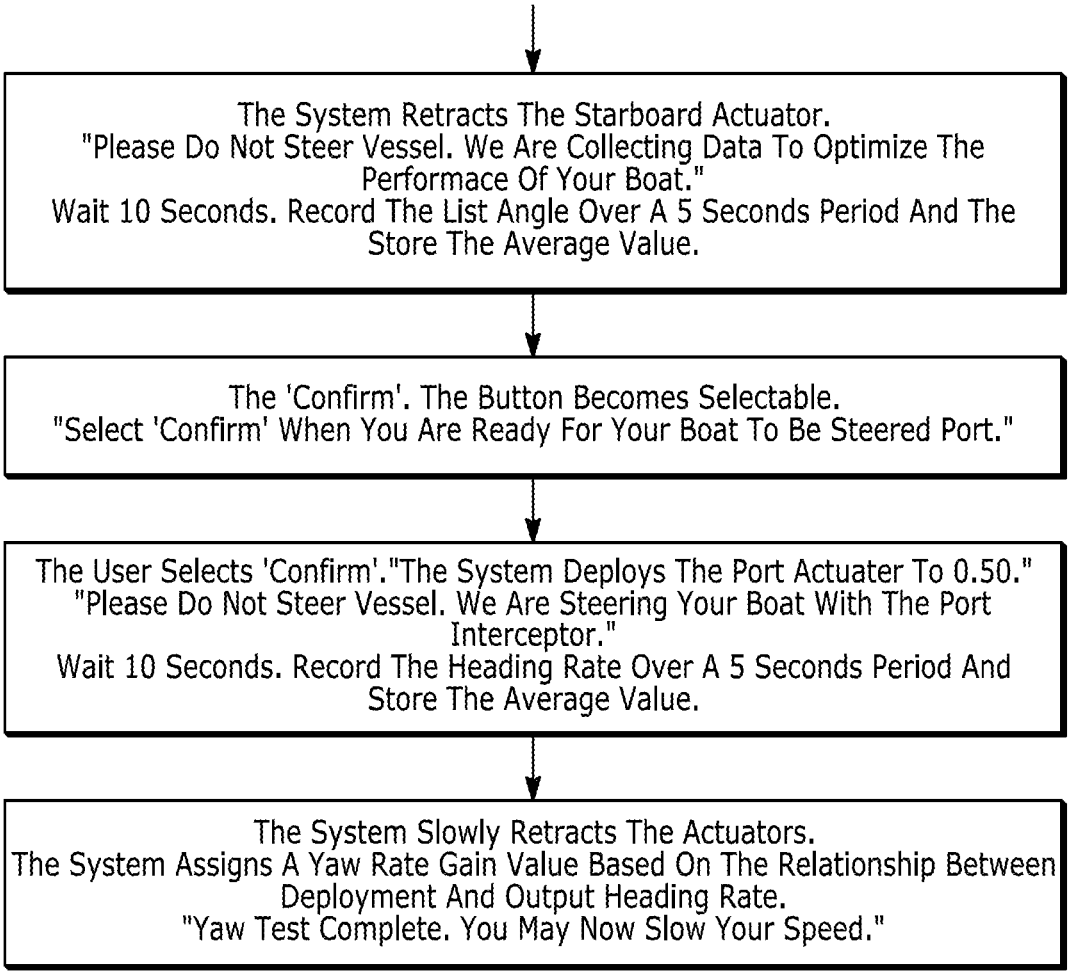

FIG. 7 illustrates an embodiment of the Commissioning Strategy in order to auto-calibrate a dynamic active control system for optimization of YRP according to one aspect of the present disclosure. As shown in FIG. 5, the commissioning strategy comprises a series of short timed test configured to provide step by step instruction to the user to auto-calibrate the system and optimize the YRP of the marine vessel.

The commissioning strategy disclosed herein do not require the steps of the algorithm flows described in the FIGS. 3, 5 and 7 flowcharts to be followed in its entirety. For instance, an operator can use or follow the algorithm flowchart in part or in whole as part of the commissioning strategy. The algorithm is configured to generate a transfer function relationship between differential deployment of the water engagement devices and roll/yaw rate and a transfer function relationship between symmetric deployment of the water engagement devices and the pitch for the marine vessel. The flowcharts illustrated in FIGS. 3, 5 and 7 describe one such workflow for accomplishing the objective of the commissioning strategy according to one aspect of the present disclosure. In alternative embodiments or other aspects of the present disclosure, other workflows or methods can be used by the operator or the user to achieve the same commissioning objective for a marine vessel.

It is understood that the preceding is merely a detailed description of some examples and embodiments of the present disclosure, and that numerous changes to the disclosed embodiments may be made in accordance with the disclosure made herein without departing from the spirit or scope of the disclosure. The preceding description, therefore, is not meant to limit the scope of the disclosure, but to provide sufficient disclosure to allow one of ordinary skill in the art to practice the disclosure without undue burden. It is further understood that the scope of the present disclosure fully encompasses other embodiments that may become obvious to those skilled in the art.

Differential and differentially are defined within this document as unequal, off center and/or involving differences in angle, speed, rate, direction, direction of motion, output, force, moment, inertia, mass, balance, application of comparable things, etc. The terms Dynamic and/or Dynamic Active Control may mean the immediate action that takes place at the moment they are needed. Any use of the term "immediate," in this application, means that the control action occurs in a manner that is responsive to the extent that it prevents or mitigates vessel motions and attitudes before they would otherwise occur in the uncontrolled situation. A person of ordinary skill in the art understands the relationship between sensed motion parameters and required response in terms of the maximum overall delay that can exist while still achieving the control objectives. "Dynamic" and/or "Dynamic Active Control" may be used in describing interactive hardware and software systems involving differing forces and may be characterized by continuous change and/or activity. Dynamic may also be used when describing the interaction between a vessel and the environment. As stated above, marine vessels may be subject to various dynamic forces generated by its propulsion system as well as the environment in which it operates. Any reference to "vessel attitude" may be defined as relative to three rotational axes including pitch attitude or rotation about the Y, transverse or sway axis, roll attitude or rotation about the X, longitudinal or surge axis, and yaw attitude or rotation about the Z, vertical or heave axis.

Various features of the example embodiments described herein may be implemented using hardware, software or a combination thereof and may be implemented in one or more computer systems or other processing systems. However, the manipulations performed in these embodiments were often referred to in terms, such as "determining," which are commonly associated with mental operations performed by a human operator. No such capability of a human operator is necessary in any of the operations described herein. Rather, the operations may be completely implemented with machine operations. Useful machines for performing the operation of the exemplary embodiments presented herein include general purpose digital computers or similar devices. With respect to hardware, a CPU typically includes one or more components, such as one or more microprocessors for performing the arithmetic and/or logical operations required for program execution, and storage media, such as one or more disk drives or memory cards (e.g., flash memory) for program and data storage, and a random access memory for temporary data and program instruction storage. With respect to software, a CPU typically includes software resident on a storage media (e.g., a disk drive or memory card), which, when executed, directs the CPU in performing transmission and reception functions.

The software (or software running on a CPU) may run on an operating system stored on the storage media, such as UNIX or Windows (e.g., NT, XP, Vista), Linux and the like, and can adhere to various protocols such as the Ethernet, ATM, TCP/IP, CAN, LIN protocols and/or other connection or connectionless protocols. As is known in the art, CPUs can run different operating systems, and can contain different types of software, each type devoted to a different function, such as handling and managing data/information from a particular source, or transforming data/information from one format into another format. It should thus be clear that the embodiments described herein are not to be construed as being limited for use with any particular type of server computer, and that any other suitable type of device for facilitating the exchange and storage of information may be employed instead.

A CPU may be a single CPU, or may include multiple separate CPUs, wherein each is dedicated to a separate application, such as a data application, a voice application and a video application. Software embodiments of the example embodiments presented herein may be provided as a computer program product, or software, that may include an article of manufacture on a machine-accessible or non-transitory computer-readable medium (i.e., also referred to as "machine readable medium") having instructions. The instructions on the machine-accessible or machine-readable medium may be used to program a computer system or other electronic device. The machine-readable medium may include, but is not limited to, floppy diskette, optical disk, CD-ROM, magneto-optical disk, USB thumb drive, and SD card or other type of media/machine-readable medium suitable for storing or transmitting electronic instructions. The techniques described herein are not limited to any particular software configuration. They may find applicability in any computing or processing environment. The terms "machine-accessible medium," "machine-readable medium" and "computer-readable medium" used herein shall include any non-transitory medium that is capable of storing, encoding or transmitting a sequence of instructions for execution by the machine (e.g., a CPU or other type of processing device) and that cause the machine to perform any one of the methods described herein. It is to be noted that it is common—as a person skilled in the art can contemplate—in the art to speak of software, in one form or another (e.g., program, procedure, process, application, module, unit, logic, and so on) as taking an action or causing a result. Such expressions are merely a shorthand way of stating that the execution of the software by a processing system causes the processor to perform an action to produce a result.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including" and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of any and all examples, or exemplary language (e.g., "such as") provided herein, is intended merely to better illuminate the invention and does not pose a limitation on the scope of the invention unless otherwise claimed. It is understood that the preceding is merely a detailed description of some examples and embodiments of the present disclosure, and that numerous changes to the disclosed embodiments may be made in accordance with the disclosure made herein without departing from the spirit or scope of the disclosure. The preceding description, therefore, is not meant to limit the scope of the disclosure, but to provide sufficient disclosure to allow one of ordinary skill in the art to practice the disclosure without undue burden.

It is further understood that the scope of the present disclosure fully encompasses other embodiments that may become obvious to those skilled in the art. Features illustrated or described as part of one embodiment can be used in another embodiment to yield a still further embodiment. Thus, it is intended that the present disclosure cover such modifications and variations as come within the scope of the appended claims and their equivalents. It is to be understood by one of ordinary skill in the art that the present discussion is a description of exemplary embodiments only, and is not intended as limiting the broader aspects of the present disclosure, which broader aspects are embodied in the exemplary constructions.

The invention claimed is:

1. A software-based commissioning method to automatically determine a plurality of feedback gain parameters for a new marine vessel, comprising:

installing a dynamic active control system having an user-interface connected to a software module; wherein the software module is communicatively and operatively connected to at least one pair of water engagement devices;

prompting a user to activate and instruct the system to asymmetrically and symmetrically deploy the at least one pair of water engagement devices;

measuring and processing data related to the motion of the vessel generated from the asymmetric and symmetric deployment of the at least one pair of water engagement devices;

analyzing the processed data for:

automatically characterizing a functional relationship between the asymmetric deployment of the at least one pair of water engagement devices and a list angle generated for a certain vessel speed, automatically characterizing a functional relationship between the asymmetric deployment of the at least one pair of water engagement devices and a yaw rate generated for a certain vessel speed, and automatically characterizing a functional relationship between the symmetric deployment at least one pair of water engagement devices and a trim angle generated for a certain vessel speed;

automatically converting the functional relationships to a plurality of vessel-specific first feedback gains; and storing the plurality of vessel-specific first feedback gains within the system of the marine vessel.

2. The software-based commissioning method of claim 1, further comprising the steps of performing a series of static tests to determine;

(a) the functional relationship between the asymmetric deployment of the at least one pair of the water engagement devices and the list angle feedback provided by the system;

(b) the functional relationship between asymmetric deployment of the at least one pair of the water engagement devices and the yaw rate feedback provided by the system; and (c) the functional relationship between symmetric deployment of at least one pair of the water engagement devices and the trim angle feedback provided by the system.

3. The software-based commissioning method of claim 1, wherein the plurality of the vessel-specific feedback gains includes a Roll Overall Gain (ROG), a Yaw Rate Gain (YRG), a Pitch Overall Gain (POG), a List Angle Gain (LAG), a Roll Rate Gain (RRG) and a Roll Angle Gain (RAG) of the marine vessel.

4. The software-based commissioning method of claim 3, wherein the Roll Overall Gain configured to mitigate any aggressive feedback data related to list angle, roll angle and roll rate of the marine vessel;

the Yaw Rate Gain is configured to mitigate any aggressive feedback data related to yaw rate of the marine vessel; and the Pitch Overall Gain is configured to mitigate any aggressive feedback data related to pitch axis motion of the marine vessel.

5. The software-based commissioning method of claim 3, further comprising the steps of performing a series of static tests to determine:

(a) the functional relationship between the asymmetric deployment of the at least one pair of the water engagement devices and the list angle feedback provided by the system;

(b) the functional relationship between asymmetric deployment of the at least one pair of the water engagement devices and the yaw rate feedback provided by the system; and (c) the functional relationship between symmetric deployment of at least one pair of the water engagement devices and the trim angle feedback provided by the system.

6. The software-based commissioning method of claim 5, wherein the steps of performing a series of static tests further comprise:

generating the Roll Overall Gain based on the functional relationship determined within step (a).

7. The software-based commissioning method of claim 5, wherein the steps of performing a series of static tests further comprise:

generating the Yaw Rate Gain based on the functional relationship determined within step (b).

8. The software-based commissioning method of claim 5, wherein the steps of performing a series of static tests further comprise:

generating the Pitch Overall Gain based on the functional relationship determined within step (c).

9. The software-based commissioning method of claim 1, further comprising the steps of auto-calibrating the system for optimization of roll reduction performance of the marine vessel.

10. The software-based commissioning method of claim 1, further comprising the steps of auto-calibrating the system for optimization of yaw reduction performance of the marine vessel.

11. The software-based commissioning method of claim 1, further comprising the steps of auto-calibrating the system for optimization of pitch reduction performance of the marine vessel.

12. The software-based commissioning method of claim 1, further comprising the steps of automatically calibrating and generating at least one speed-based bias curve for the marine vessel based on the vessel motion feedback data provided by the system.

* * * * *